US006702571B2

(12) United States Patent
Abbasi et al.

(10) Patent No.: US 6,702,571 B2
(45) Date of Patent: Mar. 9, 2004

(54) FLEX-FLAME BURNER AND SELF-OPTIMIZING COMBUSTION SYSTEM

(75) Inventors: Hamid A. Abbasi, Naperville, IL (US); David M. Rue, Chicago, IL (US); John C. Wagner, La Grange, IL (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 09/946,182

(22) Filed: Sep. 5, 2001

(65) Prior Publication Data

US 2003/0054308 A1 Mar. 20, 2003

(51) Int. Cl.[7] ..... F23N 5/00

(52) U.S. Cl. ..... 431/187; 431/186; 431/284; 431/75; 431/89; 239/562

(58) Field of Search ..... 431/187, 186, 431/188, 181, 89, 90, 12, 75, 76, 79, 279, 189, 281, 284, 174; 239/416.5, 562, 456; 60/749

(56) References Cited

U.S. PATENT DOCUMENTS

| | | | | |
|---|---|---|---|---|
| 1,024,596 A | * | 4/1912 | Oakley | 431/189 |
| 2,212,052 A | | 8/1940 | Schultz | |
| 2,907,529 A | | 10/1959 | Ghelfi | |
| 3,511,587 A | * | 5/1970 | Jansen et al. | 431/181 |
| 3,531,050 A | | 9/1970 | Abraham et al. | |
| 3,771,944 A | * | 11/1973 | Hovis et al. | 431/187 |
| 3,854,056 A | | 12/1974 | Cade | |
| 3,976,247 A | | 8/1976 | Carmelo | |
| 4,097,239 A | | 6/1978 | Patterson | |
| 4,571,172 A | * | 2/1986 | Kendall-Tobias | 431/90 |
| 4,630,554 A | * | 12/1986 | Sayler et al. | 110/264 |
| 4,652,234 A | * | 3/1987 | Voorheis | 431/281 |
| 4,726,763 A | | 2/1988 | Newman | 431/188 |
| 4,784,043 A | | 11/1988 | Kobayashi et al. | 431/188 |
| 4,793,798 A | * | 12/1988 | Sabin | 431/187 |
| 4,823,114 A | | 4/1989 | Gotisar | |
| 4,887,963 A | | 12/1989 | LeMer | |
| 4,927,350 A | | 5/1990 | Zabielski | 431/12 |
| 5,077,550 A | | 12/1991 | Cormier | |
| 5,088,423 A | * | 2/1992 | Ogura et al. | 431/187 |
| 5,222,887 A | | 6/1993 | Zabielski, Sr. | 431/12 |
| 5,249,954 A | | 10/1993 | Allen et al. | |
| 5,292,244 A | * | 3/1994 | Xiong | 431/186 |
| 5,400,971 A | | 3/1995 | Maugans et al. | |
| 5,480,298 A | | 1/1996 | Brown | 431/79 |
| 5,599,179 A | | 2/1997 | Lindner et al. | 431/12 |
| 5,651,252 A | | 7/1997 | Ansart et al. | |
| 5,785,512 A | | 7/1998 | Cormier | 431/75 |
| 5,797,736 A | | 8/1998 | Menguc et al. | 431/75 |
| 5,829,962 A | | 11/1998 | Drasek et al. | 431/12 |
| 5,971,747 A | | 10/1999 | Lemelson et al. | 431/12 |
| 5,993,194 A | | 11/1999 | Lemelson et al. | 431/75 |
| 6,045,353 A | | 4/2000 | VonDrasek et al. | 431/12 |
| 6,060,719 A | | 5/2000 | DiTucci et al. | |

FOREIGN PATENT DOCUMENTS

| | | | |
|---|---|---|---|
| EP | 0 924 463 A2 | * | 6/1999 |
| JP | 11-230540 A | * | 8/1999 |

* cited by examiner

*Primary Examiner*—Joseph Cocks
(74) *Attorney, Agent, or Firm*—Mark E. Fejer

(57) ABSTRACT

A combustion system for automatic, real-time control of a combustion process which can be applied with significant advantage to a wide range of furnaces, boilers and combustors. The system includes a burner body having a primary first fluid inlet end forming at least one primary first fluid inlet and a first fluid outlet end forming at least one first fluid outlet. An inner conduit is disposed within the burner body, forming a fluid flow region between the burner body and the inner conduit. The inner conduit has a second fluid inlet distal from the first fluid outlet and a second fluid outlet proximate the first fluid outlet. An internal adjustment device is provided for adjusting a flow cross-sectional area for a first fluid and/or a second fluid disposed within the burner body.

23 Claims, 3 Drawing Sheets

FLEX-FLAME BURNER AND SELF-OPTIMIZING COMBUSTION SYSTEM

BACKGROUND OF THE INVENTION

1. Field of the Invention

This invention relates to combustion systems having means for automatic, real-time control of the combustion process which can be applied with significant advantage to a wide range of furnaces, boilers and combustors. This invention also relates to a burner for said combustion system which, in addition to means for adjusting the firing rate and air/fuel ratio, also comprises means for adjusting flame size and shape and the degree of mixing of fuel and oxidant.

2. Description of Prior Art

For many years, efforts in the area of combustion have been focused on improving burner efficiency and lowering emissions from the combustion process. These efforts have provided significant advances in burner technology while increasing efficiency and lowering emissions. However, these effort have provided diminishing returns to combustion system operators. Currently, the greatest potential for furnace combustion improvement rests with taking a more global approach in which burners are considered as part of an interactive, real-time furnace control system. Such systems would be able to monitor, control, regulate, set or adjust the combustion process including flame characteristics and emissions over a wide turndown range and with fuel switching providing maximum thermal efficiency and minimum emissions production over substantially all furnace operating conditions, including transient operation.

Conventional combustion systems in use today comprise burners which are adjustable primarily with respect to firing rate and air/fuel ratio. As a result, these burners are tuned to a compromise setting so as to provide reasonable values of emissions and heat transfer over a wide range of firing rates. However, other than changes in flame characteristics resulting from changes in firing rate and/or oxidant/fuel ratio, these systems do not provide flame shape control or oxidant/fuel mixing control. In addition, burners used by conventional combustion systems are frequently exposed to high temperatures resulting in high maintenance and shortened service life. Accordingly, there is a need for a "smart" combustion system which can provide interactive and flexible control of the combustion process in furnaces and other combustion chambers, very effective heat transfer to a load with emissions control over high turndown ratios, with multiple fuels, and during both steady-state and transient operation.

SUMMARY OF THE INVENTION

Accordingly, it is one object of this invention to provide an interactive, real-time furnace control system which, in addition to providing control over firing rate and oxidant/fuel ratio, also provides flame shape control and oxidant/fuel mixing control.

It is another object of this invention to provide a flexible combustion system which provides very effective heat transfer to a load over high turndown ratios, with multiple fuels, and during both steady-state and transient operation.

It is yet another object of this invention to provide a combustion system with a burner providing controlled localized flame stoichiometry over a wide turndown range using multiple fuels.

These and other objects of this invention are addressed by a combustion system comprising a burner body having a primary combustion oxidant (first fluid) inlet end forming at least one primary combustion oxidant (first fluid) inlet and a combustion oxidant (first fluid) outlet end forming at least one combustion oxidant (first fluid) outlet, a fuel (second fluid) inlet distal from the combustion oxidant (first fluid) outlet and at least one fuel (second fluid) outlet proximate the combustion oxidant (first fluid) outlet, and internal adjustment means for adjusting the flow cross-sectional area for a first fluid, typically oxidant, and/or a second fluid, typically fuel, disposed within the burner body. However, it will be apparent to those skilled in the art that the first fluid may be a fuel and the second fluid an oxidant. The combustion system further comprises interactive flame sensing and control means for providing interactive, real-time control over the combustion process, including control over flame size and shape and air/fuel mixing at constant fuel input.

BRIEF DESCRIPTION OF THE DRAWINGS

These and other objects and features of this invention will be better understood from the following detailed description taken in conjunction with the drawings wherein.

DESCRIPTION OF PRESENTLY PREFERRED EMBODIMENTS

Figure 3:
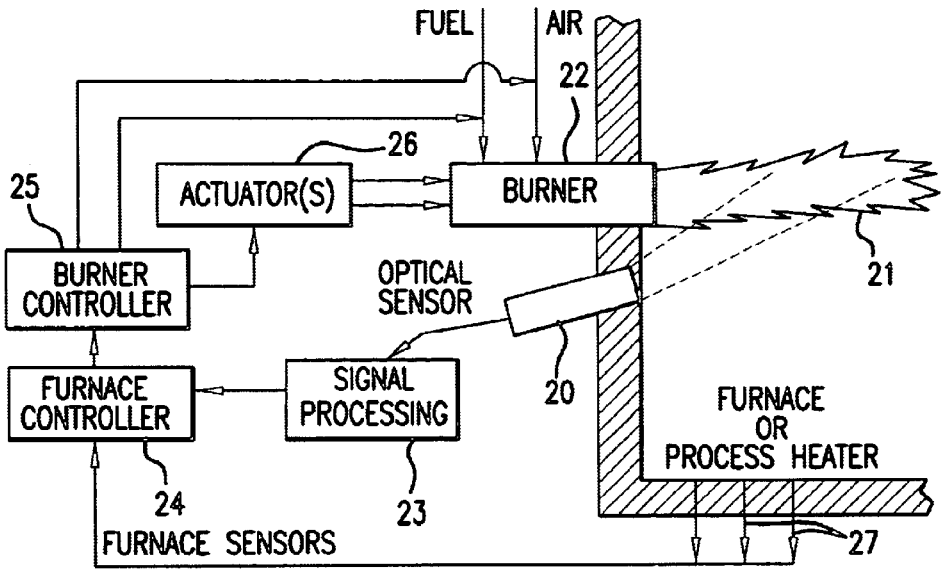
FIG. 3 is a general diagram showing the self-optimizing combustion system of this invention.

The invention claimed herein is a self-optimizing combustion system which provides interactive and flexible control of the combustion process in furnaces and other combustion chambers. The flexibility to provide controlled heat transfer to a load over high turndown ratios, with multiple fuels, and during both steady-state and transient operation is provided by combining two components, a flexible-flame burner in accordance with embodiments shown in FIGS. 4, 5 and 6 and a real-time flame sensing and control system as shown in FIG. 3.

Figure 1:
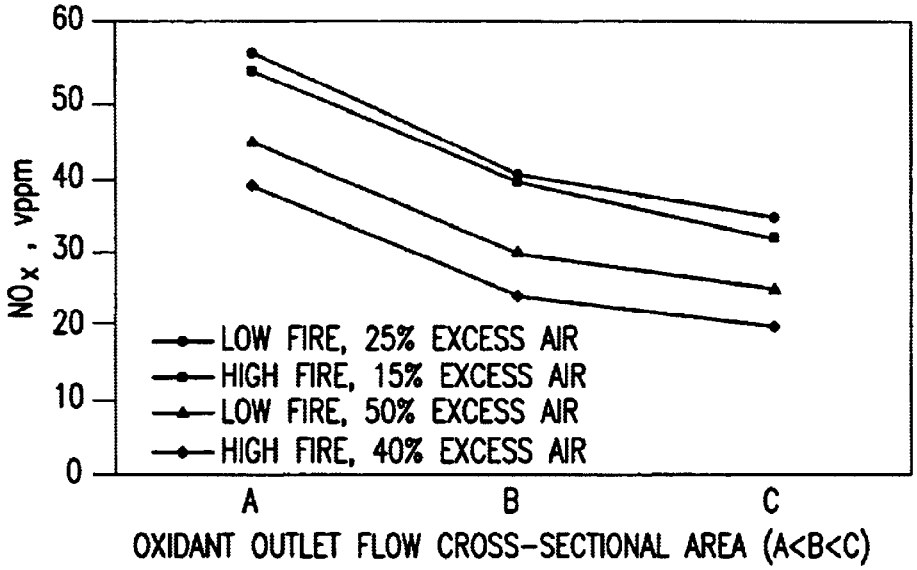
FIG. 1 is a diagram showing benefits which are derivable from the combustion system of this invention.

The flexible-flame burner of the combustion system of this invention can be adjusted for firing rate and for oxidant/fuel ratio as well as for flame shape and degree of oxidant/fuel mixing. FIG. 1 shows the results of operation of a flexible-flame burner in accordance with one embodiment of this invention. As shown, operating the flexible flame burner at constant fire and constant excess air produced as much as twice as much $NO_x$ at air flow cross-sectional area "A" compared with air flow cross-sectional area setting "C". This result was repeated at several excess air levels and several firing rates.

The capability of the combustion system of this invention for flame control is shown in Table 1 below. The flexible-flame burner was fired using natural gas at an optimized baseline condition to establish a baseline performance. The burner was then operated at a lower excess air level resulting in increases in $NO_x$ emissions, lengthening of the flame and a change in color of the flame from blue to yellow. Adjustment of the air flow cross-sectional area for the burner restored the $NO_x$ and flame characteristics to the optimized baseline conditions. In a second test, the fuel was changed from natural gas to propane, again resulting in deterioration of the flame shape. Again, adjustment of the air flow cross-sectional area restored the optimized baseline conditions.

TABLE 1

| | | Low Excess Air | | Switch to Propane | |
|---|---|---|---|---|---|
| | Optimized Baseline | No Adjustment | Flex-flame | No Adjustment | Flex-flame |
| $NO_x$,vppm | 38 | 53.5 | 31.5 | — | — |
| Flame Length | 2.5 | 3.75 | 2.75 | 3.25 | 2.5 |
| Flame Appearance | Blue | Yellow | Blue | Yellow | Blue |

As previously indicated, in addition to firing rate and oxidant/fuel ratio, the flex-flame burner of this invention allows the degree of oxidant/fuel mixing and the outlet velocity of the fuel and oxidant to be changed while maintaining a constant firing rate or while changing the firing rate. This is accomplished by internally adjusting fuel and/or oxidant flow cross-sectional areas within the burner. By changing the flow cross-sectional areas, oxidant and fuel velocities are changed and mixing patterns are adjusted. Flow cross-sectional areas are adjusted by a set of internal flow blocking devices, as will be described in more detail below, appropriately sized to more and less partially block the flow cross-sectional area passages for fuel and/or oxidant. This technique advantageously enables velocity adjustments to be made with no need for contact between hot metal surfaces.

In accordance with one embodiment of this invention, flow cross-sectional area size adjustments are made for both primary and secondary oxidant. This enables the oxidant velocity to be altered at will. Flame length, degree of mixing, flame color and amount of $NO_x$ formed are all adjusted by changing the cross-sectional flow areas. The same effect is achievable by the flex-flame burner of this invention where fuel flow areas are altered for multi-fuel burners or where several oxidants, such as air and oxygen are used for primary and secondary firing.

Figure 2:
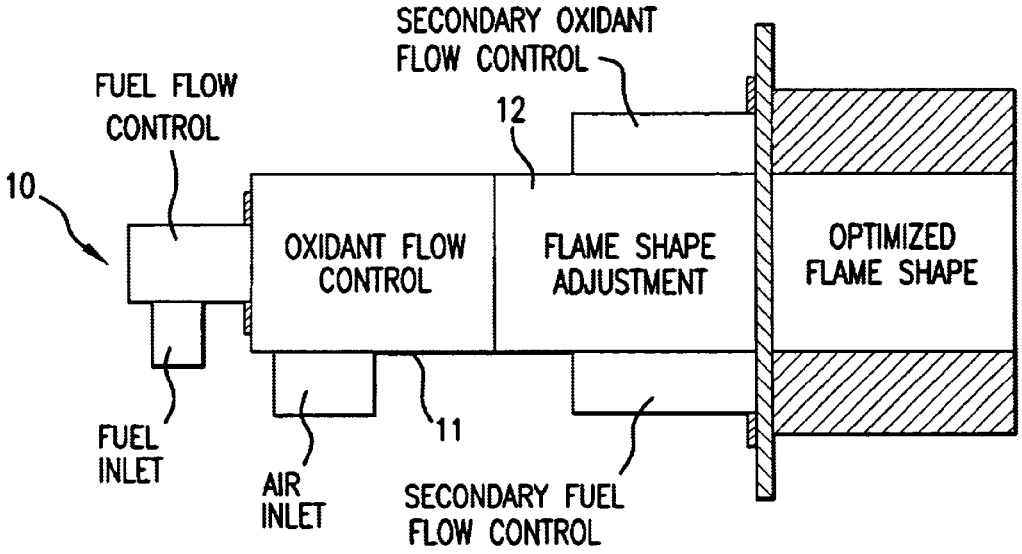
FIG. 2 is a diagram showing the broad concept of the burner employed in the combustion system in accordance with this invention.

As shown in FIG. 2, conceptually, the flex-flame burner of this invention comprises a fuel inlet/fuel flow control section 10, an oxidant inlet/oxidant flow control section 11 disposed downstream of the fuel inlet/fuel flow control section 10, and a flame shape adjustment area 12 disposed downstream of the oxidant inlet/oxidant flow control section 11 comprising a secondary oxidant flow control means and/or a secondary fuel flow control means.

FIG. 3 is a diagram showing a self-optimizing combustion system in accordance with one embodiment of this invention for providing complete, real-time control of the combustion process. The system comprises a non-intrusive optical system comprising optical sensor 20 which is adapted to observe the flame 21 produced by flex-flame burner 22 and provide information for automatic, real-time control of the combustion process. Optical sensor 20 is operatively connected to a signal processor 23 which, in turn, is operatively connected to the furnace controller 24. Furnace controller 24 is operatively connected to burner controller 25 which controls actuators 26 operatively connected to flex-flame burner 22. Actuators 26 operate to move internal adjustment means disposed within flex-flame burner 22 for adjusting the flow cross-sectional areas within the burner. Burner controller 25 is also operatively connected to means for controlling the fuel and oxidant flow into the burner, such as flow control valves. As can be seen, in addition to receiving input from the optical sensor 20, furnace controller 24 also receives input from furnace sensors, indicated by arrows 27, for input into burner controller 25.

Measurements by optical sensor 20 can be made in the ultraviolet, visible and/or infrared regions. In accordance with one preferred embodiment, the optical sensors are chemiluminescent optical diagnostic sensors. The chemiluminescent emission from flames may be interpreted as a signature chemical reaction and heat release from which flame geometry can be determined. Chemiluminescent emission line-of-sight measurements can provide information regarding flame topography, stability, behavior and even pollutants. Capabilities of the self-optimizing combustion system of this invention include 1) measurement of the flame shape, including length, height and width; 2) measurement of mixing by observing luminosity of flame regions; 3) detection of emissions in the flame, including CO and $NO_x$; 4) thermal conditions; 5) data processing and integral, feed-back control algorithms to provide monitoring and control; and 6) rapid response to adjust the combustion process to furnace instabilities, fuel changes, firing rate change (turndown), and non-steady state process heating.

Figure 4:
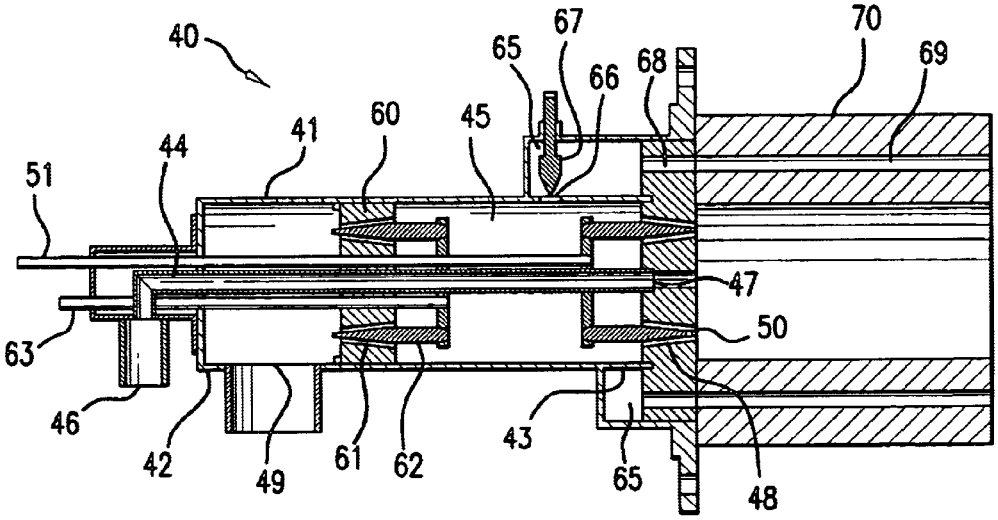
FIG. 4 is a cross-sectional lateral view of a flexible-flame burner with oxidant staging in accordance with one embodiment of this invention.

FIG. 4 is a diagram showing an exemplary flex-flame burner for a combustion system in accordance with one embodiment of this invention. Although shown as an air-staged flex-flame burner with no swirl, flex-flame burners using air staging, fuel staging, multiple fuels, internal recirculation, external recirculation, oxidant or fuel preheat and swirl are also deemed to be within the scope of this invention and no limitation of the scope of the invention to the configuration shown in FIG. 4 is to be inferred or otherwise considered to exist.

As shown, flex-flame burner 40 comprises burner body 41 having a combustion oxidant (first fluid) inlet end 42 and a combustion oxidant (first fluid) outlet end 43. Combustion oxidant outlet end 43 forms at least one combustion oxidant (first fluid) outlet 48 and combustion oxidant inlet end 42 forms at least one combustion oxidant (first fluid) inlet 49. In this example, fuel conduit 44 is disposed within burner body 41, forming a fluid flow region 45 between burner body 41 and fuel conduit 44. In accordance with one preferred embodiment of this invention, fuel conduit 44 is concentrically disposed within burner body 41. Fuel conduit 44, also referred to herein as inner conduit 44, has a fuel (second fluid) inlet 46 distal from combustion oxidant outlet end 43 of burner body 41 and a fuel (second fluid) outlet 47 proximate oxidant outlet end 43 of burner body 41. It will be apparent to those skilled in the art that the roles of fuel conduit 44 and burner body 41 with respect to fluids flowing therethrough can be exchanged, whereby oxidant (first fluid) flows through inner conduit 44 and fuel (second fluid) flows through fluid flow region 45, and such embodiments are deemed to be within the scope of this invention. Multiple fuel conduits are also deemed to be within the scope of this invention.

In accordance with the embodiment shown in FIG. 4, to adjust the flow cross-sectional areas of the combustion oxidant, flex-flame burner 40 comprises internal adjustment means disposed within burner body 41. Said internal adjustment means comprises a first flow blocking means disposed within burner body 41 suitable for partially blocking the at least one combustion oxidant outlet 48. The first flow blocking means preferably comprises at least one bluff body 50 sized to fit into the at least one combustion oxidant outlet 48. The at least one bluff body 50 is longitudinally adjustable within said burner body 41 by adjustment means such as rod 51 connected at one end to the at least one bluff body 50. In accordance with one embodiment of this invention, the at least one bluff body 50 is a needle-type structure as shown in FIG. 4. It will be apparent to those skilled in the art that other structures having other shapes may be used as well. In accordance with one embodiment of this invention as shown in FIG. 4, combustion oxidant outlet end 43 forms a plurality of combustion oxidant outlets 48 and a corresponding bluff body 50 is provided for each such outlet.

In accordance with one embodiment of this invention, the internal adjustment means comprises internal pressure adjustment means for adjusting the internal pressure in burner body 41. The internal pressure adjustment means preferably comprises a second flow blocking means disposed within burner body 41 suitable for partially blocking flow of said combustion oxidant within said burner body 41 upstream of combustion oxidant outlet 48. As shown in FIG. 4, the internal pressure adjustment means comprises an interior wall 60 disposed in fluid flow region 45 upstream of combustion oxidant outlet 48 extending from an outer surface of fuel conduit 44 to an inner surface of burner body 41 and forming at least one opening 61 for enabling flow of combustion oxidant from the primary combustion oxidant inlet 49 to the at least one combustion oxidant outlet 48. This allows for variable velocity at constant pressure, or variable flow rate at constant pressure, or constant velocity proportional to flow rate. At least one pressure altering blocking means suitable for altering flow or pressure drop of the combustion oxidant through the at least one opening 61 is disposed within burner body 41. In accordance with one embodiment of this invention, the at least one pressure altering blocking means comprises at least one bluff body 62 sized to fit into the at least one opening 61, which at least one bluff body 62 is longitudinally adjustable within burner body 41. Longitudinal adjustment of the at least one bluff body 62 in accordance with one embodiment of this invention is achieved by means of a rod 63 connected at one end to the at least one bluff body 62. In accordance with one preferred embodiment of this invention, interior wall 60 forms a plurality of openings 61 and a corresponding bluff body 62 is provided for each opening 61. It will be appreciated by those skilled in the art that other devices can be used for parts 60, 61, 62 and 63 to achieve the same pressure alteration. Such other devices are considered to be within the scope of this invention.

As shown in FIG. 4, in accordance with one embodiment of this invention, flex-flame burner 40 further comprises second stage oxidant means for introducing secondary combustion oxidant into burner body 41 between the internal adjustment means and combustion oxidant outlet 48. The second stage oxidant means comprises a secondary oxidant plenum 65 disposed around at least a portion of the outside of burner body 41. Burner body 41 forms a secondary oxidant opening 66 providing fluid communication between fluid flow region 45 and secondary oxidant plenum 65 whereby oxidant from fluid flow region 45 can flow from fluid flow region 45 into secondary oxidant plenum 65. Secondary oxidant plenum forms at least one secondary oxidant outlet 68 through which secondary oxidant is introduced into a furnace or process heater. Secondary oxidant may flow through dedicated channels 69 in refractory block 70. To control the flow of secondary oxidant into secondary oxidant plenum 65, secondary oxidant bluff body 67 is provided. Secondary oxidant bluff body 67 is sized to fit into secondary oxidant opening 66. The bluff body 67 is similar to bluff body 48.

Figure 5:
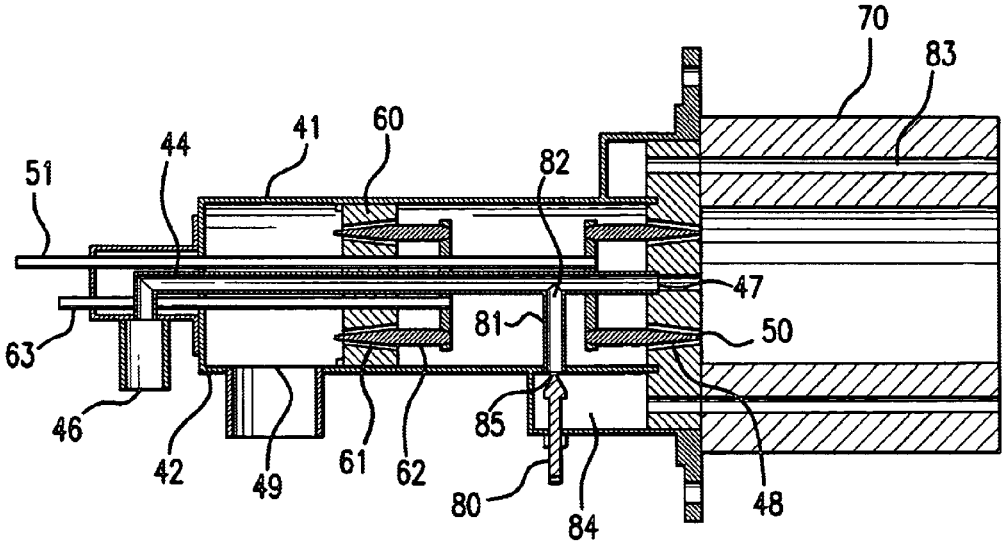
FIG. 5 is a cross-sectional lateral view of a flexible-flame burner with fuel staging in accordance with one embodiment of this invention.

FIG. 5 is a diagram of a flex-flame burner in accordance with one embodiment of this invention wherein fuel is introduced in stages into the burner. In accordance with this embodiment, inner conduit or fuel conduit 44 forms a second stage fuel outlet 82 which is in fluid communication with second stage fuel plenum 84 by means of second stage fuel conduit 81 extending between fuel conduit 44 and second stage fuel plenum 84. Second stage fuel flow is adjusted by second stage fuel bluff body 80 proximate second stage fuel inlet 85 of plenum 84 and sized to fit into second stage fuel inlet 85. Second stage fuel flows through dedicated channels 83 formed by refractory block 70.

Figure 6:
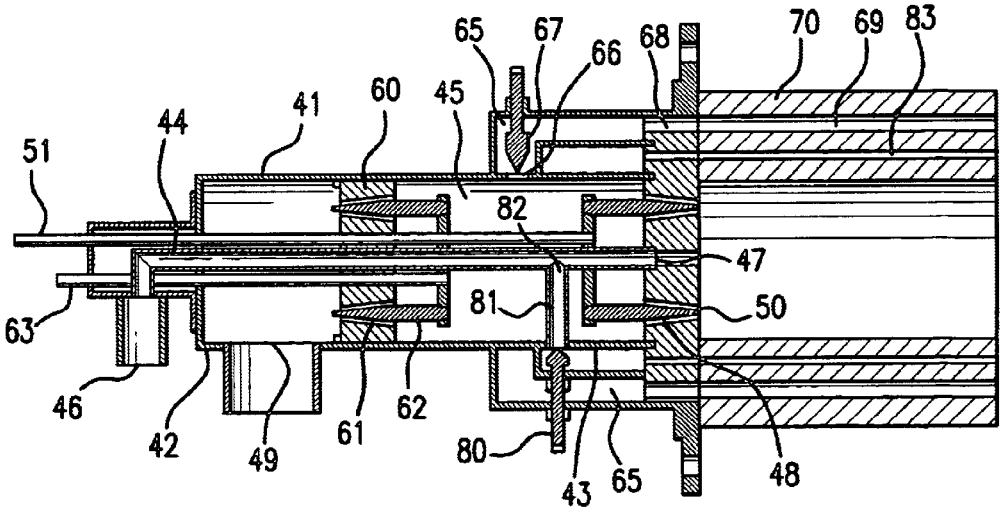
FIG. 6 is a cross-sectional lateral view of a flexible-flame burner with both fuel and oxidant staging in accordance with one embodiment of this invention.

FIG. 6 is a diagram of a flex-flame burner in accordance with one embodiment of this invention having both first and second fluid staging. This embodiment essentially constitutes a combination of the embodiments of FIGS. 4 and 5.

The flex-flame burner of this invention, as can be seen, is a relatively simple, highly adjustable burner which includes features for providing a wide range of operating conditions. This advanced burner design allows for multi-fuel capability, high turndown ratio (10:1 or greater), automatic oxidant-fuel ratio adjustment, automatic flame shape adjustment at a constant firing rate, automatic flame velocity control over a wide range of turndown ratios, flame velocity adjustment with impact on oxidant inlet pressure, automatic oxidant or fuel staging adjustment between primary and secondary oxidant or fuel introduction, and automatic mixing pattern control through the addition of desired degrees of swirl.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A combustion system comprising:

a burner body having a first fluid inlet end forming at least one primary first fluid inlet and a first fluid outlet end forming at least one first fluid outlet, said first fluid outlet oriented to deliver a first fluid to a combustion zone;

an inner conduit disposed within said burner body and forming a fluid flow region between said burner body and said inner conduit, said inner conduit having a second fluid inlet distal from said first fluid outlet and a second fluid outlet proximate said first fluid outlet, said second fluid outlet oriented to deliver a second fluid to said combustion zone without first being mixed with said first fluid;

internal adjustment means for adjusting a flow cross-sectional area of said first fluid disposed within said burner body; and internal pressure adjustment means for adjusting an internal pressure in said burner body, said internal pressure adjustment means comprising an interior wall disposed in said fluid flow region upstream of said first fluid outlet extending from an outer surface of said inner conduit to an inner surface of said burner body and forming at least one opening for enabling flow of said first fluid from said primary first fluid inlet to said at least one first fluid outlet, and at least one pressure altering blocking means disposed within said burner body suitable for altering flow of said first fluid through said at least one opening.

2. A combustion system in accordance with claim 1, wherein said internal adjustment means comprises a flow blocking means disposed within said burner body suitable for partially blocking said at least one first fluid outlet.

3. A combustion system in accordance with claim 1, wherein said internal adjustment means comprises a flow blocking means disposed within said burner body suitable for partially blocking flow of said first fluid upstream of said at least one first fluid outlet.

4. A combustion system in accordance with claim 2, wherein said flow blocking means comprises at least one bluff body sized to fit into said at least one first fluid outlet, said at least one bluff body longitudinally adjustable within said burner body.

5. A combustion system in accordance with claim 4, wherein said first fluid outlet end of said burner forms a plurality of first fluid outlets disposed around said second fluid outlet.

6. A combustion system in accordance with claim 5, wherein said flow blocking means comprises a plurality of said bluff bodies, one of said bluff bodies being disposed in each of said first fluid outlets.

7. A combustion system in accordance with claim 1, wherein said at least one pressure altering blocking means comprises at least one bluff body sized to fit into said at least one opening, said at least one bluff body being longitudinally adjustable within said burner body.

8. A combustion system in accordance with claim 1 further comprising second stage fluid means for introducing a second stage of one of said first fluid and said second fluid into said burner body between said internal pressure adjustment means and said internal adjustment means.

9. A combustion system in accordance with claim 1 further comprising interactive flame sensing and control means for controlling said internal adjustment means operably connected to said internal adjustment means.

10. A combustion system in accordance with claim 9, wherein said interactive flame sensing and control means comprises optical means for observing a flame produced by said burner body.

11. A combustion system in accordance with claim 9, wherein said interactive flame sensing and control means comprises flame shape means for measuring flame shape.

12. A combustion system in accordance with claim 9, wherein said interactive flame sensing and control means comprises mixing measurement means for determining mixing characteristics a flame produced by said burner body.

13. A combustion system in accordance with claim 9, wherein said interactive flame sensing and control means comprises stoichiometry detection means for detecting combustion stoichiometry in a flame produced by said burner body.

14. A combustion system in accordance with claim 9, wherein said interactive flame sensing and control means comprises profile detection means for detecting heat transfer profiles within a combustion chamber produced by said burner body.

15. A combustion system in accordance with claim 9, wherein said interactive flame sensing and control means comprises temperature detection means for detecting at least one of flame temperatures and surface temperatures within one of a furnace and a combustion chamber produced by said burner body.

16. A combustion system in accordance with claim 1, wherein said inner conduit is concentrically disposed within said burner body.

17. A burner comprising:

a burner body having a primary first fluid inlet end forming at least one primary first fluid inlet and a first fluid outlet end forming at least one first fluid outlet, said burner body adapted to deliver a first fluid to a combustion zone;

an inner conduit disposed within said burner body and forming a fluid flow region between said burner body and said inner conduit, said inner conduit having a second fluid inlet distal from said first fluid outlet and a second fluid outlet proximate said first fluid outlet and adapted to deliver a second fluid to said combustion zone, whereby said first fluid and said second fluid are delivered in separate streams to said combustion zone;

internal adjustment means for adjusting a flow cross-sectional area of said first fluid disposed within said burner body, said internal adjustment means comprising first flow blocking means disposed within said burner body suitable for partially blocking flow of said first fluid one of upstream of said at least one first fluid outlet and within said at least one first fluid outlet; and internal pressure adjustment means for adjusting an internal pressure in said burner body, said internal pressure adjustment means comprising an interior wall disposed in said fluid flow region upstream of said first fluid outlet extending from an outer surface of said inner conduit to an inner surface of said burner body and forming at least one opening for enabling flow of said first fluid from said primary first fluid inlet to said at least one first fluid outlet, and at least one pressure altering blocking means disposed within said burner body suitable for altering flow of said first fluid through said at least one opening.

18. A burner in accordance with claim 17, wherein said flow blocking means comprises at least one bluff body sized to fit into said at least one first fluid outlet, disposition of said at least one bluff body being adjustable within said burner body.

19. A burner in accordance with claim 18, wherein said first fluid outlet end of said burner forms a plurality of first fluid outlets disposed around said second fluid outlet.

20. A burner in accordance with claim 19, wherein said flow blocking means comprises a plurality of said bluff bodies, one of said bluff bodies being disposed in each of said first fluid outlets.

21. A burner in accordance with claim 17, wherein said at least one pressure altering blocking means comprises at least one bluff body sized to fit into said at least one opening, disposition of said at least one bluff body being adjustable within said burner body.

22. A burner in accordance with claim 17 further comprising second stage means for introducing a second stage of at least one of said first fluid and said second fluid into said burner body between said internal pressure adjustment means and said internal adjustment means.

23. A burner in accordance with claim 17, wherein said inner conduit is concentrically disposed within said burner body.

* * * * *